United States Patent [19]

Goddard

[11] 4,001,576

[45] Jan. 4, 1977

[54] LAMP SHADE

[76] Inventor: Stephen A. A. Goddard, 616 E. 19th St., Minneapolis, Minn. 55404

[22] Filed: Aug. 25, 1975

[21] Appl. No.: 607,208

Related U.S. Application Data

[63] Continuation of Ser. No. 448,936, March 7, 1974.

[52] U.S. Cl. ..... 240/108 B; 240/10 R; 240/108 R; 350/291

[51] Int. Cl.[2] ..... F21V 1/00

[58] Field of Search ..... 240/10 R, 108 R, 108 B, 240/108 D; 161/4; 350/291

[56] References Cited

UNITED STATES PATENTS

| | | | |
|---|---|---|---|
| 2,230,186 | 1/1941 | Johns et al. | 240/108 B |
| 2,478,817 | 8/1949 | Gaiser | 350/291 |
| 2,483,901 | 10/1949 | Harris | 350/291 |
| 3,209,192 | 9/1965 | Decker | 350/291 |
| 3,610,918 | 10/1971 | Barlow | 240/10 R |
| 3,823,500 | 7/1974 | Spitz | 350/291 |

*Primary Examiner*—Russell E. Adams, Jr.
*Attorney, Agent, or Firm*—Orrin M. Haugen

[57] ABSTRACT

A lamp shade structure for utilization with a conventional illuminating lamp which includes a support base and a lamp illuminating means. The shade is adapted to be utilized with conventional tungsten filament lamp radiation, and comprises a lamp enclosing shade comprising a film having a metallized coating applied to one surface thereof, the film transmitting from between about 2% to 8% of incident tungsten filament lamp radiation, and reflects the balance of from about 92% to 98%, of which a portion of the reflected light is in turn transmitted to the viewer. Unusual reflective and interference patterns are generated from the combination, with these patterns extending axially through the open ends of the lamp enclosing shade.

6 Claims, 2 Drawing Figures

FIG. 1
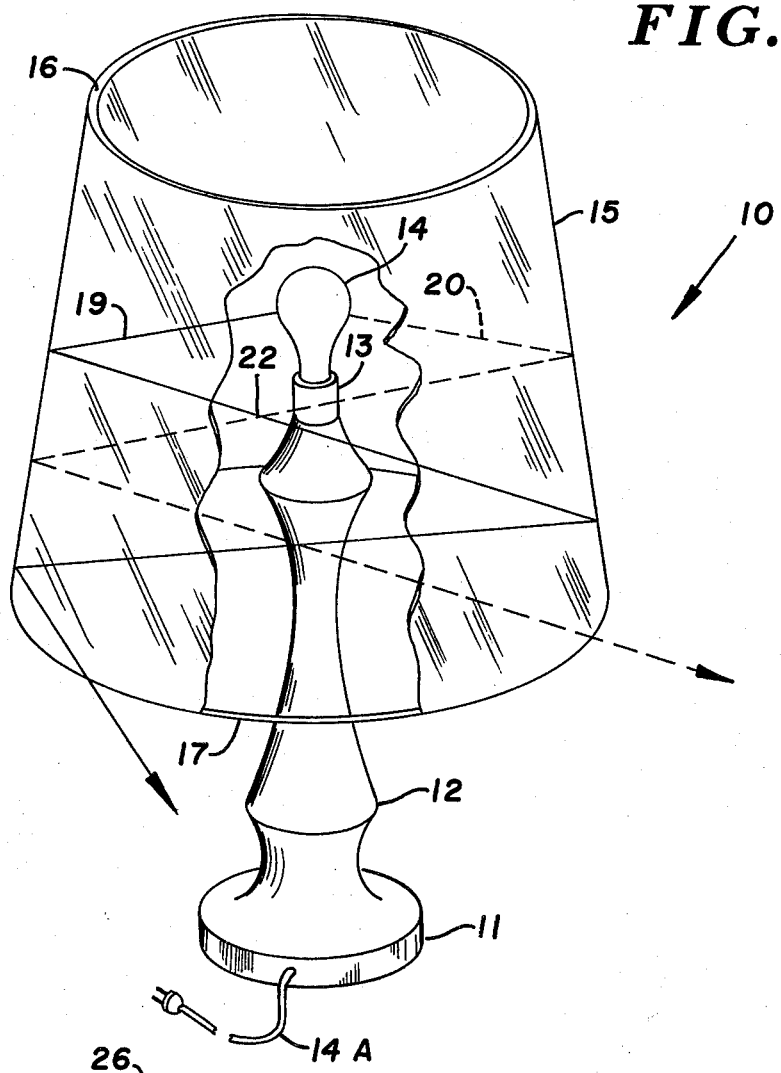
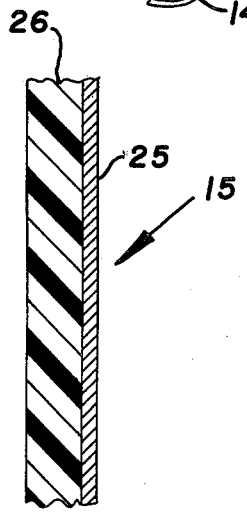
FIG. 2

LAMP SHADE

This is a continuation of application Ser. No. 448,936 filed Mar. 7, 1974.

BACKGROUND OF THE INVENTION

The present invention relates generally to an improved lamp or illuminating structure, and more specifically to a shade means for use in combination with a conventional illuminating lamp structure. The shade means of the present invention is adapted to transmit only a portion of incident tungsten filament radiation, with the balance being reflected internally so as to generate reflective and interference patterns within the structure, and specifically within the confines of the shade, and also for a limited distance outwardly of the open ends thereof.

In general, lamp shades have been transparent to limited degrees, but have tended to either absorb or otherwise handle incident radiation. For example, opaque or only partially translucent shades have been utilized wherein the incident radiation is absorbed or otherwise reflected to only a limited extent, with care being taken to provide decorative affects about the periphery of the lamp. Traditionally, these shade structures have been prepared from woven fabric, fibrous or cellulose base materials, or the like, and have generally not been fabricated from transparent substrates such as thin flexible films.

With the advent of thin transparent films such as, for example, stress-oriented polyethylene terephthalate films, it is practical to utilize these materials to achieve desired patterns with lamp structures. Specifically, these materials are desirable from the standpoint of strength, temperature stability, durability, ease of fabrication, and resistance to ordinary cleaners. It has now been learned that unusual patterns can be generated through the use of such a lamp by means of applying a metallized coating, partially transparent, and partially reflective, to a surface of the shade in order to achieve unusual patterns therewithin. In certain instances, it is desirable to utilize a dye coating in the film so as to provide a color to the reflected and transmitted radiation, with the color being, of course, readily detectable by the eye from either a point externally of the shade structure, or from a point adjacent and in viewing relationship through an open end. It has been found that the concept is useful in connection with shades disposed either on a vertical or horizontal axis, and including cylindrical or other shaped shades defining an enclosed zone.

The degree of transmission and the degree of reflection is, as previously indicated, in the range of from about 92% to 98% reflective for tungsten filament lamp radiation. More specifically, a film which is approximately 4% transmissive and 96% reflective has been found to be most desirable, with a range of from about 2% to 6% transmissive being generally preferred.

SUMMARY OF THE INVENTION

Therefore, it is a primary object of the present invention to provide an improved lamp shade structure which is adapted for use in combination with tungsten filament lamps, wherein the shade structure consists of a generally transparent film having a metallic coating adherently applied to one surface thereof, and wherein the structure is from about 94% to 98% reflective to incident radiation, balance transmissive.

It is yet a further object of the present invention to provide an improved lamp structure for use in combination with tungsten filament lamps, wherein the film has a translucent reflective metallic coating adherently applied to one surface thereof, and wherein the coating is adapted to effectively reflect from between about 94% to 98% of incident lamp radiation.

Other and further objects of the present invention will become apparent to those skilled in the art upon a study of the following specification, appended claims, and accompanying drawing.

BRIEF DESCRIPTION OF THE DRAWING

FIG. 1 is a perspective view, partially broken away, of a conventional lamp structure and showing the improved shade of the present invention; and FIG. 2 is a sectional view of a portion of the shade structure illustrating the film member retaining and supporting the adherent metallic coating thereon.

DESCRIPTION OF THE PREFERRED EMBODIMENT

In accordance with the preferred embodiment of the present invention, and with particular reference being made to the drawing, the lamp structure generally designated 10 includes a base support member 11 supporting post or pedestal 12, which, in turn, terminates at socket 13. Lamp 14 is received within socket 13, with electrical power for lamp 14 being delivered through conductor segment, as illustrated at 14A. The lamp structure is provided with shade means generally designated 15 which includes spaced apart end or ring support members 16 and 17, which are maintained in spaced apart relationship by a number of generally upstanding posts such as wire posts or the like (not shown). As indicated above, the shade means may be either cylindrical, square, or have any desirable enclosed configuration. The cross-section of the wire posts and support members 16 and 17, may, of course, be circular, square, rectangular, or the like. It will be appreciated, of course, that any of a variety of shade supporting means may be employed, including, for example, bottom-mounted spider elements and the like. In other words, the shade structure may be used without limitation relative to the internal equipment employed. The shade means 15 includes a lamp enveloping film which will be described in greater detail hereinafter, it being sufficient to note that the lamp enveloping film comprises a generally transparent film member having a translucent reflective metallic coating adherently applied to one surface thereof. It will be appreciated that the generally transparent film member may comprise a number of integral laminated films forming a single composite transparent film member. The metallic coating is partially transparent to tungsten filament lamp radiation, and is also partially reflective. The metallic coating reflects incident tungsten filament lamp radiation in the range of about 94% to 98% of such incident radiation. By way of definition, the term "transparent" is intended to refer to a substance capable of transmitting clear, uninhibited images; the term "semi-transparent" is intended to refer to a substance capable of transmission of clear images reduced in light intensity; and the term "translucent" is intended to refer to a substance capable of transmission of diffused light without a clear image.

With further attention being directed to FIG. 1 of the drawing, it will be noted that lamp 14 provides radiation directly outwardly as indicated at 19 and 20, and with the reflected rays being coincident at a point such as point 22. Further points occur outwardly of the truncated cone structure, with these coincident points being points of intense reinforced light zones of unusual or stark appearance. The incident radiation at the points of coincidence of reflected images or rays appears similar or analogous to a mirage phenomena, with the points exhibiting a rather unusual phenomena at these points.

The lamp enveloping film is in the form of a generally continuous annular ring of square or circular cross-section being disposed about the lamp, with the ring having open ends at either axial end thereof. The transparent film is preferably a clear film fabricated from commercially available film-forming substances such as stress oriented polyethylene terephthalate or the like. Stress oriented polyethylene terephthalate is available from the E. I. DuPont deNemours Corp. of Wilmington, Delaware under the trade name "Mylar." In addition to polyester films such as polyethylene terephthalate, vinyl films or laminated films may also be employed to fabricate the light enveloping structure useful in accordance with the present invention.

In order to achieve a greater degree of reflectivity of the structure, it is preferred that the film material be thin in cross-section, so as to avoid absorption of radiation therewithin. Furthermore, if a dye is to be employed, it is preferred that the dye be incorporated in only modest quantities so as to render the material highly transparent to incident radiation. Modest quantities of dyes may be incorporated in the film without achieving significant degrees of absorption.

While the ranges of reflectivity and transparency have been set forth hereinabove, it will be appreciated that the total reflectivity and transmission relates to non-absorbed energy, with moderate absorptivity being permissible. With only modest quantities of dye being incorporated in the film, it is, nevertheless, believed possible to achieve modest or moderate absorption in the film. For practical purposes, the total radiation which is either absorbed or reflected would, under these circumstances, approach substantially 99% of the total incident radiation from the tungsten filament lamp, such as the lamp 14.

In one embodiment of the invention, it has been found that a bi-laminate material may be employed having a dye coating arranged along one of the interior surfaces. Alternatively, however, the bulk film may contain a dye as distinguished from the utilization of a "coating" of dye. When a dye coating is employed, it is normally desirable to utilize the coating on both sides of the film in order to have the same color characteristics appear on both sides. In such an arrangement, therefore, a dye coating will be applied to one of the surfaces of the film with a metallic coating such as a coating of aluminum being applied to a second or outer coating of the overall structure. In certain instances, however, it may be desirable to apply the metallized coating along an inner surface of a bilaminate material so as to provide a protective environment for the film, and thus eliminate tendencies toward oxidation, sulfiding, or the like. Frequently, it is desirable to metallize both sides of a colored film, including the metallization of both sides of a film containing a dye coating on either side thereof.

Also, in order to protect the nature of the metallized film coating, it may be desirable to coat the metal surface with a thin layer of an optically transparent coating, which will protect the metal surface from exposure to hostile environments including oxygen, sulfides, and the like. Aluminium is desired as a material for the metallic film portion, with the aluminum providing a highly reflective but yet sufficiently thin layer so as to become and remain transparent. Aluminum is reasonably resistant toward surface oxidation, however, it is important to maintain the metal film out of contact with ambient so as to reduce the tendency and rate of oxidation. In order to achieve this result with a modest degree of additional effort, however, a laminated film containing two or three individual integral film members laminated together provides protection against scratching of the metallized coating as well as resistance to ammonia and other ingredients of conventional household cleaners.

In lieu of a coating of aluminum, other metals may also be employed, such as copper, silver, nickel, or the like. These metals are all susceptible to vapor or sputter deposition, and as such, commercially available metallized films are obtainable.

In order to achieve a minimum degree of absorptivity, the lamp enveloping film is preferably between about 6 and 15 mils in cross-sectional thickness, with greater thicknesses being useful, however. Specifically, 0.25 mil polyethylene terephthalate is useful and also is readily available, with thinner gauges of 0.15 mil material also being useful and commercially available. Gauges up to 10 mils are, of course, readily commercially available as well and may consist of polyethylene terephthalate, vinyls or the like. As indicated above, these individual films may be laminated together so as to provide a single cohesive integral laminate structure having a thickness in the range of, for example, up to 20 to 30 mils. As the size of the shade structure increases, the requirements for heavier film also increase. This is necessary in order to achieve proper physical and mechanical stability of the finished product.

In one typical embodiment of the present invention, vapor coated aluminum was applied to polyester film, specifically stress oriented polyethylene terephthalate, with this material being available from the Industrial Tape Division of Minnesota Mining and Manufacturing Company of St. Paul, Minnesota under the designation "Scotch Tent A-33." For use ultimately, however, the material is treated so as to be free of any coatings other than the aluminum metal coating. The material is optically clear, and has been found to respond favorably to treatment with incident tungsten filament lamp radiation.

In one specific embodiment of the present invention, a film of 5 mil Mylar was coated with a metallized layer of aluminum on either side thereof until the structure reflected 95% of incident radiation from tungsten filament lamp. The treatment was substantially equal on either side of the film, that is, the aluminized layers were substantially equal in thickness. Conventional metallization techniques are employed, these being well known in the art. This film was then coated with a layer of adhesive on either side thereof and a film of 5 mil Mylar bonded to either surface thereof. This provided a composite laminate structure having the characteristic of reflecting tungsten filament lamp radiation in a range of 95% of total, with the balance of 5% being transmitted through the enveloping film layer.

I claim:

1. In combination with a lamp structure having a base, a lamp receiving means, lamp illuminating means within said receiving means, and self-supporting shade means disposed in enveloping relationship about said illuminating means, said shade means comprising:

a. frame means receiving and structurally supporting a lamp enveloping film defining a generally continuous annular ring about said illuminating means with open ends at opposed ends thereof; and b. said lamp enveloping film comprising a generally transparent film having a semi-transparent reflective metallic coating adherently applied to at least one surface thereof and being characterized in that said coating is partially reflective and partially transparent to incident lamp radiation, with the metallic coating reflecting tungsten filament lamp radiation in a range of about 94% to 98% of total incident radiation, balance of from about 2% to 6% being transmitted through said lamp enveloping film.

2. The combination as defined in claim 1 being particularly characterized in that said generally transparent film consists essentially of stress oriented polyethylene terephthalate.

3. The combination as defined in claim 2 being particularly characterized in that said metallic coating consists essentially of aluminum.

4. The combination as defined in claim 1 being particularly characterized in that said lamp enveloping film has a thickness of less than about 30 mils.

5. The combination as defined in claim 1 being particularly characterized in that said film is prepared with colored material.

6. The combination as defined in claim 1 being particularly characterized in that said lamp enveloping film comprises a laminate of three individual film members, with a coating being applied to opposed surfaces of the film member disposed centrally in said laminate structure.

* * * * *